US006218007B1

(12) United States Patent
Russell et al.

(10) Patent No.: US 6,218,007 B1
(45) Date of Patent: Apr. 17, 2001

(54) METHOD OF PRODUCING HIGH QUALITY DARK DYEING POLYESTER AND RESULTING YARNS AND FABRICS

(75) Inventors: David Michael Russell; Winston Patrick Moore; Robert Alton Usher, Jr., all of Charlotte, NC (US)

(73) Assignee: Wellman, Inc., Charlotte, NC (US)

( * ) Notice: Subject to any disclaimer, the term of this patent is extended or adjusted under 35 U.S.C. 154(b) by 0 days.

(21) Appl. No.: 09/313,919

(22) Filed: May 18, 1999

(51) Int. Cl.[7] ..... D01F 6/62
(52) U.S. Cl. ..... 428/364; 428/395; 528/372
(58) Field of Search ..... 528/372; 428/364, 428/395

(56) References Cited

U.S. PATENT DOCUMENTS

| | | |
|---|---|---|
| 3,341,512 | 9/1967 | Wegmuller et al. . |
| 3,377,129 | 4/1968 | Wegmuller et al. . |
| 4,526,738 | 7/1985 | Miyoshi et al. . |
| 4,666,454 | 5/1987 | DeMartino et al. . |
| 4,975,233 | 12/1990 | Blaeser et al. . |
| 5,008,230 | 4/1991 | Nichols . |
| 5,091,504 | 2/1992 | Blaeser et al. . |
| 5,135,697 | 8/1992 | Roderiguez et al. . |
| 5,272,246 | 12/1993 | Roderiguez et al. . |

FOREIGN PATENT DOCUMENTS

| | | |
|---|---|---|
| 0 109 647 B1 | 3/1990 | (EP) . |
| 0 372 994 A2 | 6/1990 | (EP) . |
| 0 109 647 B2 | 9/1993 | (EP) . |
| 0 372 994 B1 | 12/1995 | (EP) . |
| WO 92/13120 | 8/1992 | (WO) . |

*Primary Examiner*—N. Edwards
(74) *Attorney, Agent, or Firm*—Philip Summa, P.A.

(57) ABSTRACT

A method is disclosed for spinning polyester staple to produce dark dyeing yarns as compared to yarns having an otherwise similar composition. The method includes spinning polyester staple into yarn, in which the polyester includes between about 0.5 and 4 percent by weight of polyethylene glycol, into yarn in a rotor spinning machine at a rotor speed of between about 110,000 and 120,000 rpm and at a tension of between about 2.5 and 3.2 grams/tex. A resulting polyester fiber is also disclosed of between about 1.2 and 2.25 denier per filament, and that contains between about 0.5 and 4 percent by weight of polyethylene glycol, and with a fiber tenacity of 4.7 grams per denier or less.

10 Claims, 2 Drawing Sheets

METHOD OF PRODUCING HIGH QUALITY DARK DYEING POLYESTER AND RESULTING YARNS AND FABRICS

FIELD OF THE INVENTION

The present invention relates to the manufacture of polyester fibers for textile applications, and in particular relates to an enhanced polyester copolymer fiber material which demonstrates improved tensile properties and improved dyeability.

BACKGROUND OF THE INVENTION

Polyester has long been recognized as a desirable material for textile applications. The basic processes for the manufacture of polyester are relatively well known and straightforward, and fibers from polyester can be appropriately woven or knitted to form textile fabric. Polyester fibers can be blended with other fibers such as wool or cotton to produce fabrics which have the enhanced strength, durability and memory aspects of polyester, while retaining many of the desired qualities of the natural fiber with which the polyester is blended.

As with any fiber, the particular polyester fiber from which any given fabric is formed must have properties suitable for manufacture, finishing, and end use of that fabric. Typical applications include ring, open-end, and air jet spinning, either with or without a blended natural fiber, weaving or knitting, dyeing, and finishing. In addition, it has long been known that synthetic fibers such as polyester which are initially formed as extruded linear filaments, will exhibit more of the properties of natural fibers such as wool or cotton if they are treated in some manner which changes the linear filament into some other shape. Such treatments are referred to generally as texturizing, and can include false twisting, crimping, and certain chemical treatments.

In a homopolymeric state, polyester exhibits good strength characteristics. Typical measured characteristics include tenacity, which is generally expressed as the grams per denier required to break a filament, and the modulus, which refers to the filament strength at a specified elongation ("SASE"). Tenacity and modulus are also referred to together as the tensile characteristics or "tensiles" of a given fiber. In relatively pure homopolymeric polyester, the tenacity will generally range from about 3.5 to about 8 grams per denier, but the majority of polyester has a tenacity of 6 or more grams per denier. Only about 5 percent of polyester is made with a tenacity of 4.0 or less.

In many applications, of course, it is desirable that the textile fabric be available in a variety of colors, accomplished by a dyeing step. Substantially pure polyester, however, is not as dyeable as most natural fibers, or as would otherwise be desired, and therefore must usually be dyed under conditions of high temperature, high pressure, or both, or at atmospheric conditions with or without the use of swelling agents commonly referred to as "carriers." Accordingly, various techniques have been developed for enhancing the dyeability of polyester.

One technique for enhancing the dyeability of polyester is the addition of various functional groups to the polymer to which dye molecules or particles such as pigments themselves attach more readily, either chemically or physically, depending upon the type of dyeing technique employed. Common types of additives include molecules with functional groups that tend to be more receptive to chemical reaction with dye molecules than is polyester. These often include carboxylic acids (particularly dicarboxylic or other multifunctional acids), and organo metallic sulfate or sulfonate compounds.

Polyethylene glycol ("PEG") is another additive that has been shown to offer improved dyeing characteristics when incorporated with polyester into textile fibers. If other practical factors and necessities are ignored, adding increased amounts of PEG to polyester increases the dyeability of the resulting polymer. Nevertheless, there are a number of disadvantages associated with the application of polyethylene glycol to polyester using these prior techniques, particularly when the PEG is added in amounts of 5 to 6 percent or more by weight, amounts which some references indicate are necessary to obtain the desired enhanced dyeability. These disadvantages are not generally admitted in the prior art patents and literature, but are demonstrated to exist by the lack of known commercial textile processes which use fibers formed essentially solely from copolymers of polyester and polyethylene glycol. These shortcomings can be demonstrated, however, by those of ordinary skill in the art using appropriate evaluation of the prior technology.

Most notably, commercially available fibers formed from polyester-polyethylene glycol copolymers tend to exhibit improved dyeability at the expense of tensiles; improved dyeability at the expense of shrinkage; improved tensiles at the expense of shrinkage; poor light fastness; poor polymer color (whiteness and blueness); unfavorable process economies; and poor thermal stability.

An improvement in the use of polyethylene glycol is disclosed in U.S. Pat. No. 4, 975,233 to Blaeser et al. for "Method of Producing and Enhanced Polyester Copolymer Fiber." The Blaeser '233 patent teaches that the dyeability and tensile properties of a polyester filament can be enhanced by incorporating between about 1 and 4 percent by weight of the polyethylene glycol, and thereafter drawing and heat setting the resulting filament. Blaeser '233 suggests heat setting temperatures of about 370° F., fibers of about 1.0 dpf and rotor spinning rotor speeds of about 95,000 rpm.

In general, however, using polyethylene glycol to increase dye uptake still requires high pressure techniques (with their associated costs and environmental control aspects) and an undesirable reduction in yarn quality. Additionally, the heat setting steps that help stabilize some of the yarn properties tend to produce fiber and yarn properties that discourage disperse dye uptake. Moreover, because the presence of polyethylene glycol still tends to decrease fiber and yarn strength, deep dyed polyester yarns (or blended yarns) have not been produced at spinning speeds greater than those achieved by the Blaeser '233 technique.

Accordingly, present techniques for increasing the dyeability of polyester fibers, yarns and fabrics all tend to require certain compromises among physical properties, available spinning speeds, costs, and related other factors.

OBJECT AND SUMMARY OF THE INVENTION

Therefore, it is an object of the present invention to provide a further improvement in the dyeability of polyester fibers, yarns, and fabrics, and in blends of polyester and cotton, while reducing, minimizing, or eliminating some of the compromises required using presently available techniques.

Accordingly, it has now been discovered, that even greater improvements in fiber, yarn and fabric dyeability can be achieved while incorporating higher spinning speeds and atmospheric, rather than pressure, dyeing techniques. In this regard, the invention can provide conventionally available dye depth using significantly less dyestuff. Alternatively, deeper colors can be achieved using previously conventional amounts of dyestuff, or dyeing time can be reduced by a significant amount to obtain particular or desired dye uptake.

In particular, the invention provides a method of spinning polyester staple to produce dark dyeing yarns as compared to yarns having an otherwise similar composition by spinning polyester staple into yarn, in which the polyester includes between about 0.5 and 4 percent by weight of polyethylene glycol, into yarn in a rotor spinning machine at a rotor speed of between about 110,000 and 120,000 rpm and at a tension of between about 2.5 and 3.2 grams per tex (g/tex). Speeds of up to 150,000 rpm are possible, but are presently less favored because such speeds introduce other technical difficulties and changes in the yarn characteristics.

In another aspect, the invention comprises spinning polyester (polyethylene terephthalate) staple in which the polyester includes polyethylene glycol in an amount of between about 0.5 and 4 percent by weight; in a rotor spinning machine at a rotor speed (RS) of between about 110,000 and 120,000 rpm; and at a tension in grams (T) defined by a linear relationship (y=mx+b) between T and RS.

In yet another aspect, the invention is a polyester fiber (not sliver, not yet yarn) of between about 1.2 and 2.25 denier per filament, and containing between about 0.5 and 4 percent by weight of polyethylene glycol, and with a fiber tenacity of 4.7 grams per denier or less.

The foregoing and other objects and advantages of the invention and the manner in which the same are accomplished will become clearer based on the following detailed description, taken together with the accompanying drawings, in which:

DETAILED DESCRIPTION

Figure 1:
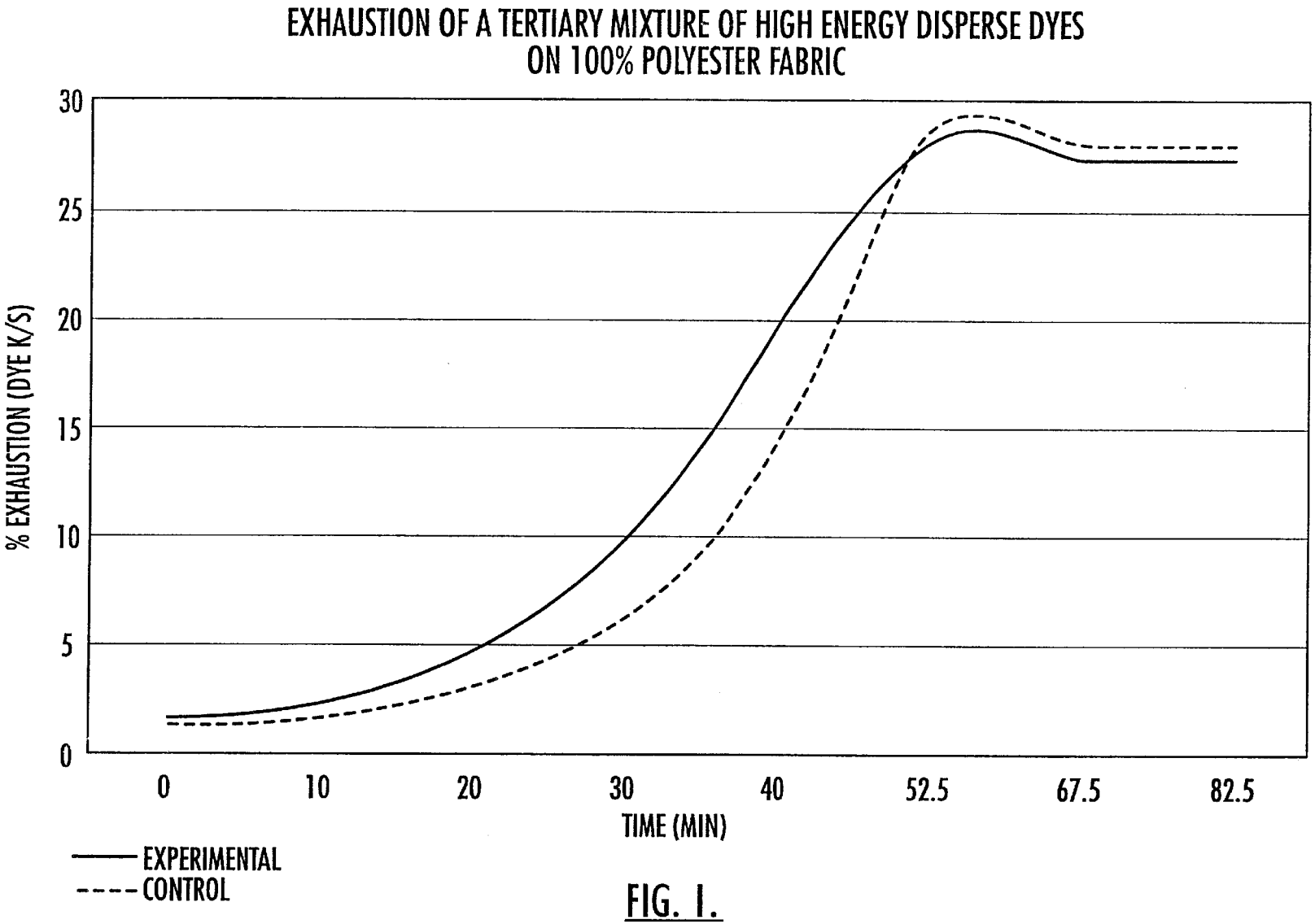
FIG. 1 is a plot comparing dye exhaustion between conventional polyester and polyester according to the claimed invention.

The invention is a method of spinning polyester staple to produce dark dyeing yarns as compared to yarns having an otherwise similar composition. In brief, the invention provides a deeper dyeing polyester yarn with more uniform color, and resulting polyester and blended fabrics, at greater productivity levels than have conventionally been possible at such dye levels. In many cases the invention provides dye shades at atmospheric pressure that were previously available only under high pressure. The ability to obtain such color and color uniformity at atmospheric pressure also offers the potential to reduce the capital costs of dyeing such yarns and fabrics. Although in some cases the spinning efficiency and yarn strength may be somewhat less than those of comparative polyester without the polyethylene glycol, the gain in productivity for deeply dyed colors is often well worth the exchange. In other cases, the efficiency remains comparable.

In a first aspect the invention is a method that comprises spinning polyester into yarn in which the polyester includes between about 0.5 and 4% by weight, and preferably 2% by weight, of polyethylene glycol into yarn in a rotor spinning machine at a rotor speed of between about 110,000 and 120,000 rpm and at a tension of between about 2.5 and 3.2 grams per tex (preferably between 2.58 and 3.14 g/tex).

In most embodiments the method can further comprise spinning the polyester filament that contains between about 0.5 and 4% by weight of polyethylene glycol from a spinneret, and thereafter cutting the filament into staple lengths, both prior to the step of spinning the staple into yarn.

As those familiar with the manufacturer of synthetic fibers are well aware, the term "spinning," is used in two separate senses. In the first sense, it refers to the production of a synthetic polymer filament from a melt of the polymer, usually by forcing the polymer in its liquid state (i.e., melted) through the openings of a spinneret.

In another sense, but one which is used just as widely, the term "spinning" refers to the mechanical combination and twisting together of individual fibers into yarns.

Because these terms are so well known and so well understood to those of ordinary skill in this art, their use in the present application for both purposes will be readily apparent from the context in which the term is used.

In preferred embodiments, the step of spinning polyester staple into yarn comprises spinning staple having a denier per filament of between 1.2 and 2.25, accordingly, the prior step of spinning the melted polyester into filament likewise comprises forming a filament of those dimensions. The filament is typically heat set before being cut into staple, and in the invention, the heat step is preferably carried out at somewhat lower temperatures (e.g., between about 250 and 370° F., with about 320° F. preferred) than in conventional techniques.

Similarly, the method can further comprise forming fabrics, typically woven or knitted fabrics from the spun yarn. Perhaps most advantageously, and as will be evident from the data presented herein, the method preferably comprises dyeing either the fabric or the spun yarn to take advantage of the deep dyeing properties of the polyester that is produced according to the method of the invention.

Because polyester is so often advantageously blended with cotton and other fibers, the method also includes spinning a blend of cotton and polyester staple into yarn in which the polyester includes between about 0.5 and 4% by weight of polyethylene glycol into yarn in a rotor spinning machine at rotor speeds of between about 110,000 and 120,000 rpm at a tension of between about 2.5 and 3.2 g/tex.

As in the first embodiment, the method can further comprise spinning the original polyester and polyethylene glycol filament from a melt and thereafter cutting the filament into staple lengths. Similarly, the method typically comprises forming a woven or knitted fabric from the blended yarn with the yarn being either dyed as spun yarn, or after incorporation into the fabric in which case it is dyed as a fabric.

The basic techniques for forming polyester filament from commercially available raw materials are well known to those of ordinary skill in this art and will not otherwise be repeated herein. Such conventional techniques are quite suitable for forming the filament of the invention, provided that the polyethylene glycol is included in the appropriate amounts.

The denier of the polyester in such blends again preferably falls between 1.2 and 2.25 dpf. The cotton and polyester can be blended in any appropriate proportion, but in the most preferred embodiments the blend includes between about 35 and 65% by weight of cotton with the remainder polyester. Blends of 50% cotton and 50% polyester ("50/50") are often most preferred.

In another aspect, the invention comprises spinning the polyester staple that includes the polyethylene glycol in the amount of between about 0.5 and 4% by weight in a rotor spinning machine at a rotor speed (RS) of between about 110,000 and 120,000 rpm and at tension in grams (T) defined by a straight line the following relationship: i.e., y=mx+b. It has been discovered according to the present invention that these parameters produce the polyester yarns and fabrics with the exceptional dyeing properties set forth herein.

Although the tension can be controlled by various techniques known to those of ordinary skill in this art, it has been discovered that a relatively new type of ceramic navel offers particular advantages. More specifically, the Tribofil FTOE4 navel made by CeramTec AG of Plochingen, Germany, is particularly useful for keeping the tension at the desired limits. For these CeramTec navels, the relationship between tension in g/tex (T) and rotor speed in rpm (RS) is expressed as T=0.000052RS−3.09. For more conventional Schlafhorst KN4 navels, the relationship can be expressed as T=0.000061RS−3.85.

As in the other embodiments, in this aspect the method can further comprise spinning the polyester filament from a melt that contains between about 0.5 and 4% by weight of polyethylene glycol and thereafter cutting the filament into staple lengths, both prior to the step of spinning the staple into yarn. In this aspect, the method can likewise comprise forming woven and knitted fabrics from the spun yarn, as well dyeing either the spun yarn or the fabric.

As in the previous embodiments, the advantages of the invention appear to be most pronounced when the staple has a denier per filament of between about 1.2 and 2.25.

The yarn formed according to this embodiment can likewise be incorporated into blends with cotton, and is known to those familiar with such blending processes, the cotton is typically blended with polyester staple fiber before spinning the blend into yarn. As set forth above, the blend preferably contains between about 35 and 65% by weight cotton with 50/50 blends being typical.

In another aspect, the invention comprises a polyester fiber with significantly increased dye uptake capabilities as compared to previous fibers of similar composition. In this aspect, the invention comprises a polyester fiber of between about 1.2 and 2.25 dpf and containing between about 0.5 and 4% by weight of polyethylene glycol with a fiber tenacity of 4.7 grams per denier or less. In this aspect, the invention can also comprise a yarn formed from the polyester fiber or a blended yarn of cotton and staple from the polyester fiber. The yarn in turn can be formed into fabrics which are typically dyed, either as yarn or as fabric.

Results

Fiber and yarns produced according to the invention have shown disperse dye cost savings of 20–38 percent with an increase in rotor spinning take up speeds of 9–24 percent. Reducing fiber tenacity greater than 1.3 g/d, adding polyethylene glycol in the amount of 0.5–4%, increasing fiber denier by 0.7–1.25 denier per filament (dpf), and utilizing spinning components that reduce spinning tension, produce these dye savings and productivity increases.

In preferred embodiment, the invention uses the CeramTec navels in combination with the aforementioned fiber characteristics at open end rotor spinning speeds between 110,000–120,000 rpm. As known to those of skill in this art, in rotor (open-end) spinning, fiber tenacity and modulus translate directly to spinning efficiency, and dye uptake bears an inverse relationship with tenacity and modulus. Therefore, conventional techniques for producing dark dyeing polyester typically compromise spinning performance. A copolymer can be added to maintain the current fiber tenacity level while increasing the dye uptake level (e.g., Blaeser '233). Also, low fiber heat set temperatures will reduce fiber crystallization (modulus), thereby further increasing dye strike rate. Increasing fiber denier will also increase dye level. These latter two methods, however, inherently compromise rotor spinning performance. In contrast, the present invention, potentially including the use of rotor spinning components that reduce spinning tension, permits dark dyeing fiber to be spun at speeds exceeding current commercially known spinning take up speeds for polyester blends.

Dye Reporting

Dye evaluations were performed on 100 percent polyester puffs to define the dye difference against commercial controls. 100 percent polyester fabrics were then knitted and dyed by an independent research lab to confirm results and determine dye cost reduction. Dye puff analysis was performed with an Atlas LP-1 launderometer. The dye procedure for the puff analysis included a 30:1 liquor ratio using 2% on weight of fiber disperse Blue 27. A pH of 4.5–5.0 was maintained using acetic acid. 1.0 g/l of DS-12, a leveling agent provided by Sybcon Chemicals, Wellford, S.C. was also used. No carrier was used in the dyeing. The temperature was raised to 130° C. at a rate of 1.8° C. per minute and then held for 45 minutes. The temperature was then lowered to 50° C. Samples were then washed with hot water to remove any excess dyestuff and dried. For this evaluation, the reflectance of each sample was measured using a HunterLab Model UltraScan XE.

Dyeability data is typically set forth using the Kabelka-Monk equation which is defined as the ratio of absorption (K) to light scattering (S). The K/S ratio is defined as follows:

$$\frac{K}{S} = \frac{(1-R)^2}{2R} \begin{array}{l} \text{–Coefficient of absorption} \\ \text{–Coefficient of scatter} \end{array}$$

It should be noted that the K/S value varies reasonably linearly with concentration of dye on the material. K/S values for the commercial control, 1.7, and 2.25 dpf samples are provided below. For simplicity, the K/S of the 1.7 and 2.25 dpf samples were ratioed to the commercial control and presented in terms of percentages.

| Sample | Dye K/S | % of control |
|---|---|---|
| 1.0 dpf control | 2.35 | 100 |
| 1.7 dpf deep dye | 3.20 | 136 |
| 2.25 dpf deep dye | 3.27 | 139 |

For the independent fabric evaluation, test fabrics of a commercial control, and fabrics formed from the 1.7 and 2.25 dpf products were submitted to the test laboratory as samples 001, 002, and 003. The laboratory was instructed to dye the commercial control (sample 001) to a particular shade and then match samples 002 and 003 to the 001 shade. All independent dyeings were performed by BASF Corporation, 4330 Chesapeake Drive, Charlotte, N.C. Fabrics were dyed in three shades with differing dye chemistry to represent a broad range of dyestuffs and dye costs. Dyes used were DISPERSOL Crimson SF, DISPERSOL Navy CVS 300 (tertiary), and DISPERSOL Blue C-RN 200. In addition, a strike rate analysis was performed using the 1.0 dpf control and the 1.7 dpf sample according to the invention to assess differences in fiber dye take up. FIG. 1 is a plot of the exhaustion results with the line labeled "EXPERIMENTAL" representing the 1.7 dpf sample. The strike rate analysis was performed using the DISPERSOL Navy CVS. Samples were removed from the dye bath over time and K/S values recorded to determine the dye strike of each sample. Note that though the fabrics were dyed to the same final shade, the strike rate for sample 002 is still significantly higher.

Dye Cost Analysis

Control fabrics were dyed to a shade and commercially matched with the 1.7 and 2.25 dpf products. The reduction in dye % On Weight Of Fiber (OWF) required to match the control shade with the 1.7 and 2.25 dpf was used to determine the dye cost savings for each shade. The calculation of dye cost savings were calculated according to the following example:

The equation for the reduction in dyestuff required for a sample versus the commercial control is given by:

$$\frac{k/s_{control}}{k/s_{sample}} \times \frac{\%\ OWF_{sample}}{\%\ OWF_{control}}$$

(Note that though they were dyed to a commercial shade match, k/s is considered to account for any differences in final dye shade).

For example, using DISPERSOL Crimson SF, 1.7 dpf versus the control gives the following reduction in dye required:

$$(13.29/13.27)\times(1.07/1.5)=0.71.$$

i.e., the invention provides the same color while using only 71% of the dye needed using a conventional technique.

To obtain the comparative exemplary reduction in dye cost, the control fiber dye cost can be multiplied by the reduction in dye required. The cost of dyeing the control in \$/lb is obtained by multiplying the dye cost per pound by the pounds of dye used based on % OWF: \$35.5/lb×0.015 lb=\$0.53. Therefore, the dye cost reduction for 1.7 dpf would be (0.71)×(\$0.53)=\$0.38.

Tables 1, 2, and 3 show dye cost comparisons for the three evaluations performed.

TABLE 1

Dye Cost Comparison for DISPERSOL Crimson SF

| Sample | % OWF | Dye k/s | Cost (\$/lb fabric) | % Reduction |
|---|---|---|---|---|
| 1.0 dpf control | 1.5 | 13.29 | \$0.53 | 0 |
| 1.7 dpf | 1.07 | 13.27 | \$0.38 | 28.3 |
| 2.25 dpf | 1.00 | 13.02 | \$0.36 | 32.1 |

TABLE 2

Dye Cost Comparison for DISPERSOL Navy CVS 300

| Sample | % OWF | Dye k/s | Cost (\$/lb fabric) | % Reduction |
|---|---|---|---|---|
| 1.0 dpf control | 1.5 | 29.58 | \$0.21 | 0 |
| 1.7 dpf | 1.13 | 29.24 | \$0.16 | 24.6 |
| 2.25 dpf | 0.97 | 30.28 | \$0.13 | 38.1 |

TABLE 3

Dye Cost Comparison for DISPERSOL Blue C-RN 200

| Sample | % OWF | Dye k/s | Cost (\$/lb fabric) | % Reduction |
|---|---|---|---|---|
| 1.0 dpf control | 1.00 | 17.12 | \$0.21 | 0 |
| 1.7 dpf | 0.78 | 16.78 | \$0.17 | 20 |
| 2.25 dpf | 0.70 | 17.20 | \$0.14 | 33 |

The invention is particularly effective, because the disperse dye cost savings are not compromised by the conventional loss in rotor spinning take up productivity or efficiency. As noted earlier herein, prior techniques can obtain the disperse dye cost reduction achieved by the invention through lower fiber heat settings, higher fiber deniers, and copolymer introduction into the polyester. In such prior technique, however, the dye cost reduction is typically offset by the loss in spinning take up speed and efficiency. Because lower fiber tensiles result in lower yarn strength, spinning speeds and efficiencies are directly affected.

The present invention permits high-speed rotor spinning at comparable spinning tensions at rotor speeds higher than are conventionally possible for polyester/cotton blends, and thus produces deep dye polyester/cotton yarns at increased spinning speeds.

Figure 2:
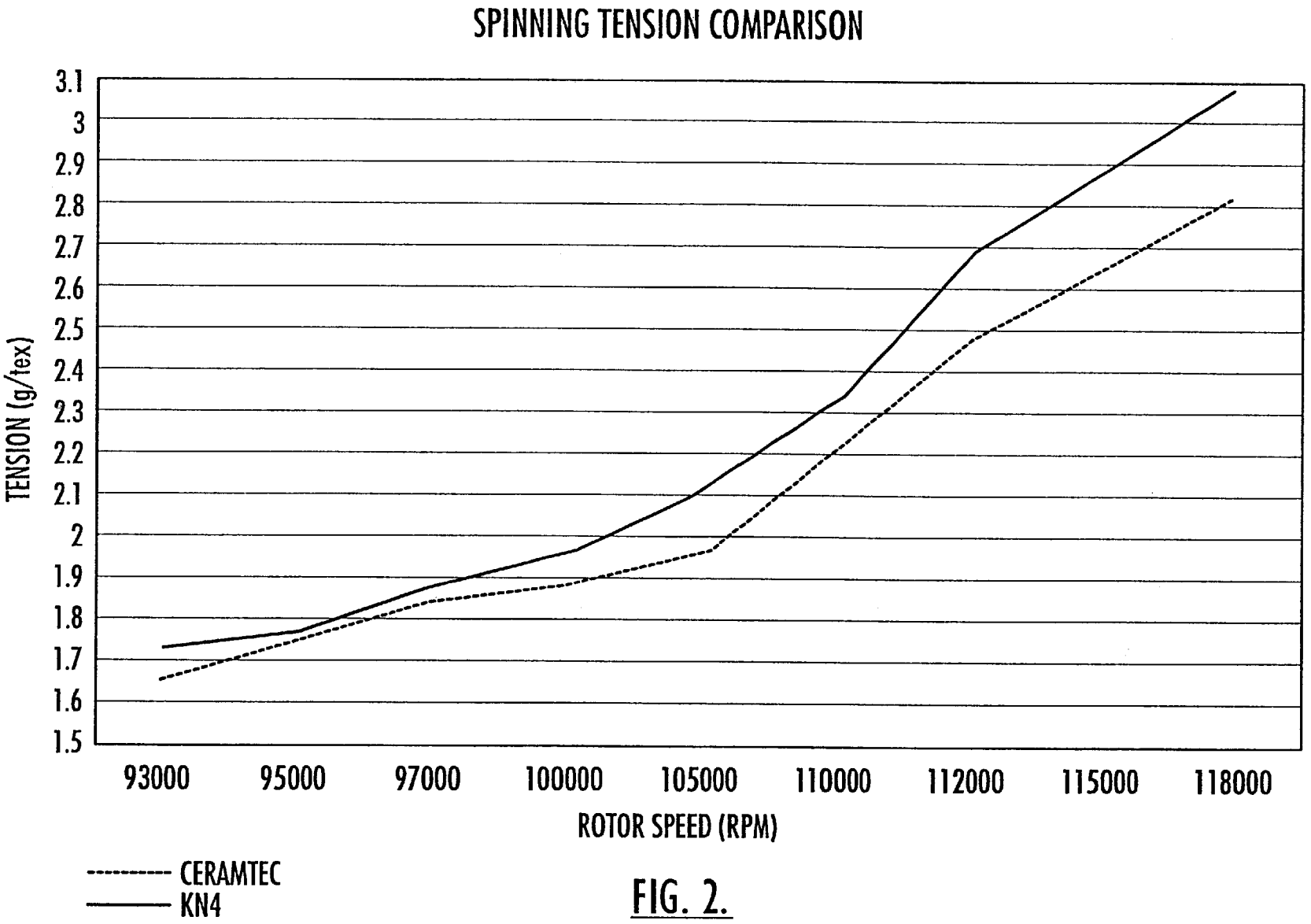
FIG. 2 is a plot comparing spinning tension between two types of navels at various rotor speeds.

These advantages are further illustrated by the data, which is plotted in FIG. 2, in which 1.7 dpf deep dye polyester was used in 50/50 poly/cotton yarn spun to 18/1 on Schlafhorst Autocoro ACO-240 with an SE-9 spinbox. The study was conducted using Schlafhorst KN4 navels, long known as an industry standard, and the previously cited low tension navels from CeramTec.

As rotor speeds were increased, tension increased for the KN4 navel at a rate given by the following equation:

$$\text{Tension, grams}=0.000061\text{RS (rotor speed, rpm)}-3.85$$

Tension increased for the experimental navel at a rate given by the following:

$$\text{Tension, grams}=0.000052\text{RS (rotor speed, rpm)}-3.09$$

As seen by the two equations, the slope given for the CeramTec navel indicates lower tension than the KN4 navel as rotor speeds increase. It should be noted that above a rotor speed of 97,500 rpm, positions running the KN4 navels had repeated yarn breaks such that it was difficult to take tension measurements, and ends down data was not recorded because the positions broke out within five minutes on average. In addition, STAFF data, an indicator of yarn shedding, was in excess of 14 mg per 10 g yarn. STAFF for the experimental navels was 2.3 mg per 10 g yarn. STAFF data and the inability to produce the 1.7 dpf at acceptable ends down levels indicates that commercial navels cannot be used to produce a deep dyeing polyester at known commercial spinning speeds.

To further validate the invention's advantages, yarn spinning evaluations were performed on the Schlafhorst Autocoro ACO-240 with an SE-9 spinbox using typical settings for poly-cotton yarns. Such settings are well known or easily developed by those of ordinary skill in this art.

Rotor spinning take up speeds are defined by:

$$\text{Take up speed} = \frac{\text{Rotor speed}}{tpm} = \text{meters/minute}$$

where rotor speed is in revolutions per minute (rpm) and yarn turns per meter (tpm) is defined by the following equation:

$$tpm = \frac{(Ne)^{1/2} * a_e * 1000}{25.4}$$

where Ne is the yarn count in English cotton count and Ae is the twist multiplier.

A typical knit yarn count and fiber blend was used in the experimentation. All spinning was evaluated using an 18/1 yarn count, 50/50 blend of 1.7 dpf deep dye polyester and cotton in an intimate blend. The control fiber was 18/1 count 50/50 1.0 dpf polyester blended with the same cotton used for the dark dyeing fiber evaluations. The 50/50 blend was carded on a Trützschler DK760 at a speed of 180 meters/minute. The 60 grain per yard card sliver was second pass drawn to 55 grains per yard using a Rieter RSB 851 drawframe. Autoleveling was used to maintain sliver evenness on drawing the second pass.

The control yarn and the 1.7 dpf deep dyeing polyester were spun at two conditions designed to capture the typical range of industry conditions used for SE9 spun knit yarns.

Rotor speed, rotor type, twist multiplier, and navel type for the two conditions are given below:

| | Take Up Speed | Rotor Speed | Rotor Type | Twist Multiplier (TM) | Navel | Ends Down per 1000 Rotor Hours 1.0 dpf Control | 1.7 dpf |
|---|---|---|---|---|---|---|---|
| Setup 1 | 176 m/min | 97,000 rpm | G33 | 3.3 | KN4 | 95 | 437 |
| Setup 2 | 200 m/min | 100,000 rpm | T31 | 3.0 | KN4 | 71 | 465 |

Spinning performance for both the control and the deep dyeing variant under normal commercial conditions are given above. Total spinning time on the frame was 42 spindle hours for each variant.

Using the new high speed rotor spinning components, several trial setups were analyzed in an effort to improve spinning take up speed and efficiency. The trial setups are summarized below.

| Spinning Setup | Take Up Speed | Rotor Speed | Rotor Type | TM | Navel Type | Ends Down per 1,000 rotor hours | Total Spindle Hours |
|---|---|---|---|---|---|---|---|
| 1 | 200 m/min | 100,000 rpm | T31 | 3.0 | CeramTec FTOE4 | see note | see note |
| 2 | 200 m/min | 110,000 rpm | T31 | 3.3 | CeramTec FTOE4 | 1125 | 8 |
| 3 | 203 m/min | 112,000 rpm | T31 | 3.3 | CeramTec FTOE4 | 317 | 56 |
| 4 | 208.6 m/min | 115,000 rpm | T31 | 3.3 | CeramTec FTOE4 | 213 | 132 |
| 5 | 215.2 m/min | 115,000 rpm | T31 | 3.2 | CeramTec FTOE4 | 417 | 48 |
| 6 | 214.1 m/min | 118,000 rpm | T31 | 3.3 | CeramTec FTOE4 | see note | 8 |
| 7 | 217.7 m/min | 120,000 rpm | T31 | 3.3 | CeramTec FTOE4 | see note | 4 |

(Note: Positions would not piece, or yarn would experience a low tension break shortly after piecing; therefore, the spinning tension was judged too low to successfully evaluate the setup.)

Problems with the yarn piecer were experienced in Setup 6 and 7. If a position experienced a yarn break, the piecer could not piece the yarn break at the high spindle speeds; therefore, ends down data from the final two spinning setups would not be relevant, and are not provided. Spinning performance continued to be acceptable, however, at the higher speeds, and with modifications to the piecer, spinning performance should be expected to improve as spinning speed increases. Investigation of the yarn formation failures also indicated that 75 percent of the ends down were due to yarn thin outs, which would indicate a lack of spinning tension in the rotor. Higher spinning tension via increased rotor speed is thus expected to reduce the number of spinning breaks, and subsequently, provide further increases in throughput.

In summary, the invention provides a deeper dyeing polyester yarn with more uniform color, and resulting polyester and blended fabrics, at greater productivity levels than have conventionally been possible. In many cases the invention provides dye shades at atmospheric pressure that were previously available only under high pressure. The ability to obtain such color and color uniformity at atmospheric pressure also offers the potential to reduce the capital costs of dyeing such yarns and fabrics. Although the spinning efficiency and yarn strength are somewhat less than those of conventional polyester without polyethylene glycol, the gain in productivity for deeply dyed colors is often well worth the exchange.

In the drawings and specification, there have been disclosed typical embodiments of the invention, and, although specific terms have been employed, they have been used in a generic and descriptive sense only and not for purposes of limitation, the scope of the invention being set forth in the following claims.

What is claimed is:

1. A fiber consisting essentially of polyethylene terephthalate and polyethylene glycol and having a denier range of 1.2 to 2.25 denier per filament, and containing from 0.5 to 4 percent by weight of said polyethylene glycol, and with a fiber tenacity of 4.7 grams per denier or less.

2. A yarn formed from polyester fiber according to claim 1.

3. A fabric formed from yarn according to claim 2.

4. A fabric according to claim 3 selected from the group consisting of woven fabrics and knitted fabrics.

5. A dyed fabric according to claim 4.

6. A yarn formed from a blend of cotton and polyester fiber according to claim 1.

7. A yarn according to claim 6 wherein the cotton is present in an amount of between about 35 and 65 percent by weight of the blend.

8. A fabric formed from blended yarn according to claim 6.

9. A fabric according to claim 8 selected from the group consisting of woven fabrics and knitted fabrics.

10. A dyed fabric according to claim 9.

* * * * *

UNITED STATES PATENT AND TRADEMARK OFFICE

CERTIFICATE OF CORRECTION

PATENT NO. : 6,218,007 B1
DATED : April 17, 2001
INVENTOR(S) : Russell, et al.

It is certified that error appears in the above-identified patent and that said Letters Patent is hereby corrected as shown below:

Title page,
Insert -- Related Application Data
Divisional of U.S. Patent Application 09/066,162, now U.S. Patent No. 6,067,785. --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*